US005934502A

United States Patent [19]

Lira

[11] Patent Number: 5,934,502

[45] Date of Patent: Aug. 10, 1999

[54] HANDLE HOLE COVER

[75] Inventor: Martin G. Lira, Lake Mills, Wis.

[73] Assignee: Menasha Corporation, Neenah, Wis.

[21] Appl. No.: 08/920,249

[22] Filed: Aug. 28, 1997

[51] Int. Cl.[6] ..... B65D 5/46

[52] U.S. Cl. ..... 220/770; 229/117.16

[58] Field of Search ..... 220/23.2, 676, 220/770, 516; 229/117.16, 117.17

[56] References Cited

U.S. PATENT DOCUMENTS

| | | | |
|---|---|---|---|
| 3,153,491 | 10/1964 | MacTavish et al. | 220/770 |
| 3,809,279 | 5/1974 | Arias | 220/516 |
| 4,359,183 | 11/1982 | Aida et al. | 229/117.16 |
| 4,550,048 | 10/1985 | Nakagawa | 229/117.16 X |
| 5,074,461 | 12/1991 | Parker et al. | 229/117.16 X |
| 5,727,728 | 3/1998 | Sainz et al. | 229/117.16 |

*Primary Examiner*—Steven Pollard

*Attorney, Agent, or Firm*—Quarles & Brady

[57] ABSTRACT

A cover for the handle hole of a plastic tote box container has a peripheral rectangular flange which is grommeted to the inside of the container wall with side runs and a bottom run of the flange even with the sides and bottom of the handle hole. The top run of the flange is spaced above the top of the handle hole to make room for the distal phalanges of the fingers. A top wall of the cover extends inwardly from the top run of the flange and joins at its inner end with a rear wall which is parallel to the end wall of the container. The lower end of the rear wall is joined to a bottom wall of the cover which slopes upwardly from the bottom run of the flange. The top, rear and bottom walls are joined to each other and to the side runs of the flange by inwardly sloping side walls of the cover, so the cover is completely closed. The grommets extend through tabs of the bottom and side runs of the flange, and the side grommets extend into pockets defined adjacent to the sides of the handle hole on the outside of the container end wall by reinforcing ribs.

5 Claims, 2 Drawing Sheets

HANDLE HOLE COVER

BACKGROUND OF THE INVENTION

This invention relates to portable storage containers having handle holes at opposite ends, and particularly to a cover for the handle holes.

A common form of storage container takes the form of a box with a top and with holes near the top at opposite ends of the box to accommodate grasping by the fingers of the human hand. The containers are often molded from plastic resins. The cross section of the ends of the box about the holes are built up to form a handle that is comfortable for grasping.

Such containers are used to store a wide variety of goods. When the goods are small in size and are packed to the top of the box, the contents can spill out through the handle holes. The solution in the past has been to refrain from packing small goods to the top of the box. This can waste significant capacity in the container.

SUMMARY OF THE INVENTION

The present invention provides a cover for each handle hole. The cover is attached to the inside of the box about the hole to close the opening but to accommodate the fingers. The cover is configured to protect the contents of the container and to provide a comfortable recess for the fingers of the hand.

The invention comprises a cover having a peripheral flange that surrounds the perimeter of a handle hole and that is adapted to be attached to the inside of the container. An enclosed recessed portion extends from the flange. The recessed portion has a rear wall spaced from the flange and a top wall connecting the rear wall to the flange. The top wall is located above the upper edge of the handle holes so that the recessed portion will accommodate the distal phalanges of fingers extending through the handle hole.

The cover is preferably formed with the recessed portion integral with the flange. The cover may be molded from plastic resin. The cover is attached to the container by grommet or rivet fasteners which extend through tabs of the bottom and side runs of the flange, and the side fasteners extend into pockets formed on the outside of the container end wall at the sides of the handle hole by reinforcing ribs. Preferably, the recessed portion has an upwardly sloping bottom wall that connects the rear wall to the flange, and inwardly sloping side walls that connect the rear wall to the flange.

The typical handle hole in a container is oblong. The flange is preferably substantially rectangular with the bottom and sides of the flange being aligned with the bottom and sides of the hole and with the top of the flange spaced above the top of the handle hole.

It is a principal object of the invention to provide a cover for open handle holes in a container which reduces spillage, enables more efficient use of the container capacity and provides protection for the user and for the contents of the container.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
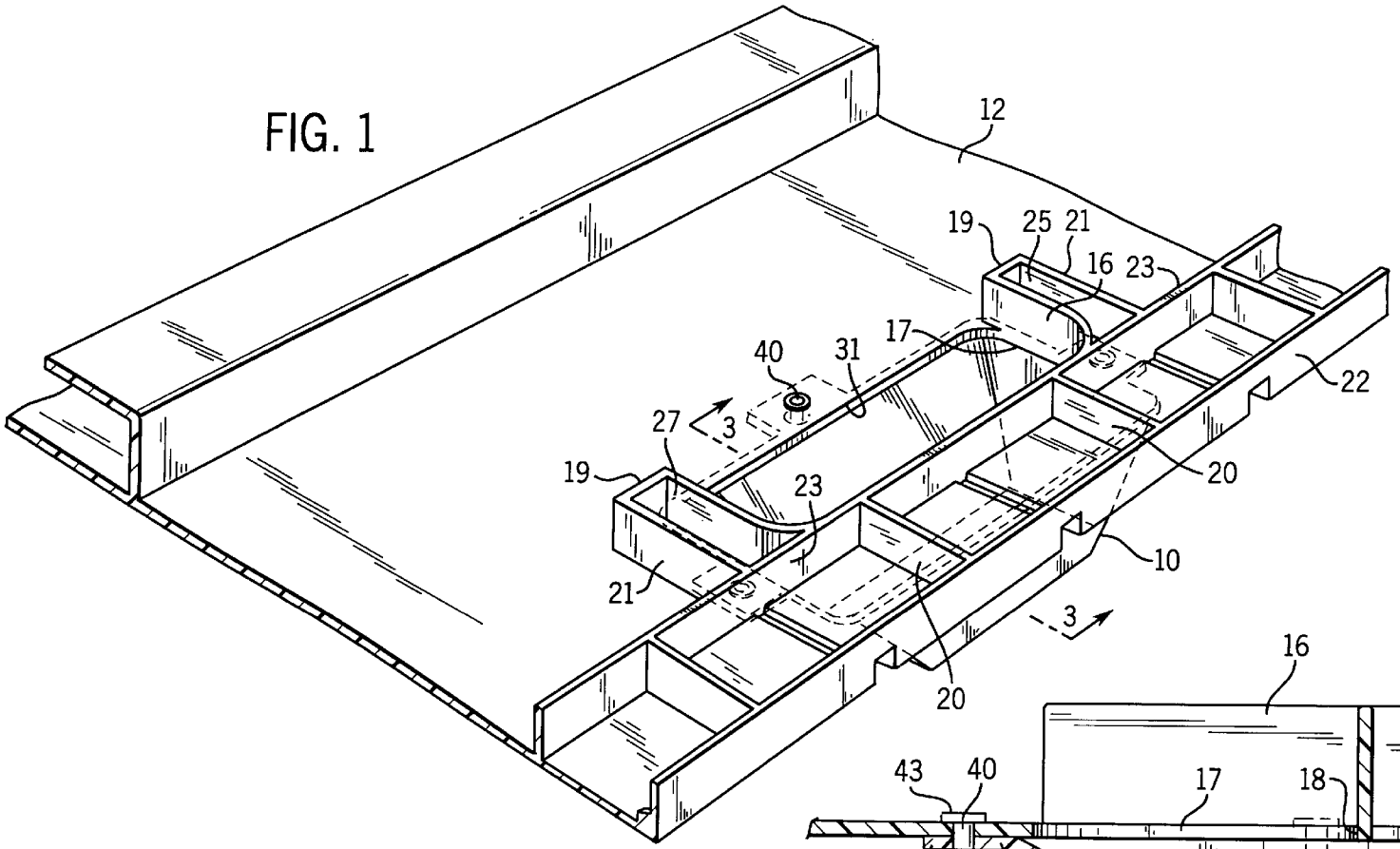
FIG. 1 is a view in perspective of a portion of the end wall of a container with the cover in place.
Figure 3:
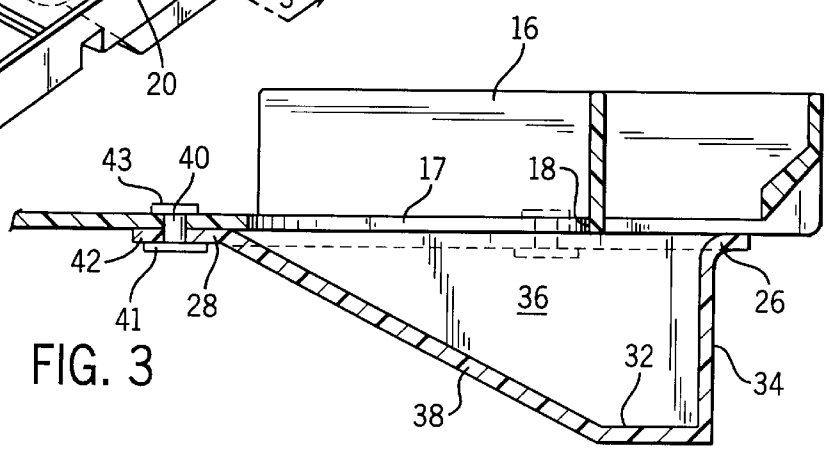
FIG. 3 is a view in cross-section taken in the plane of the line 3–3 of FIG. 1.
Figure 2:
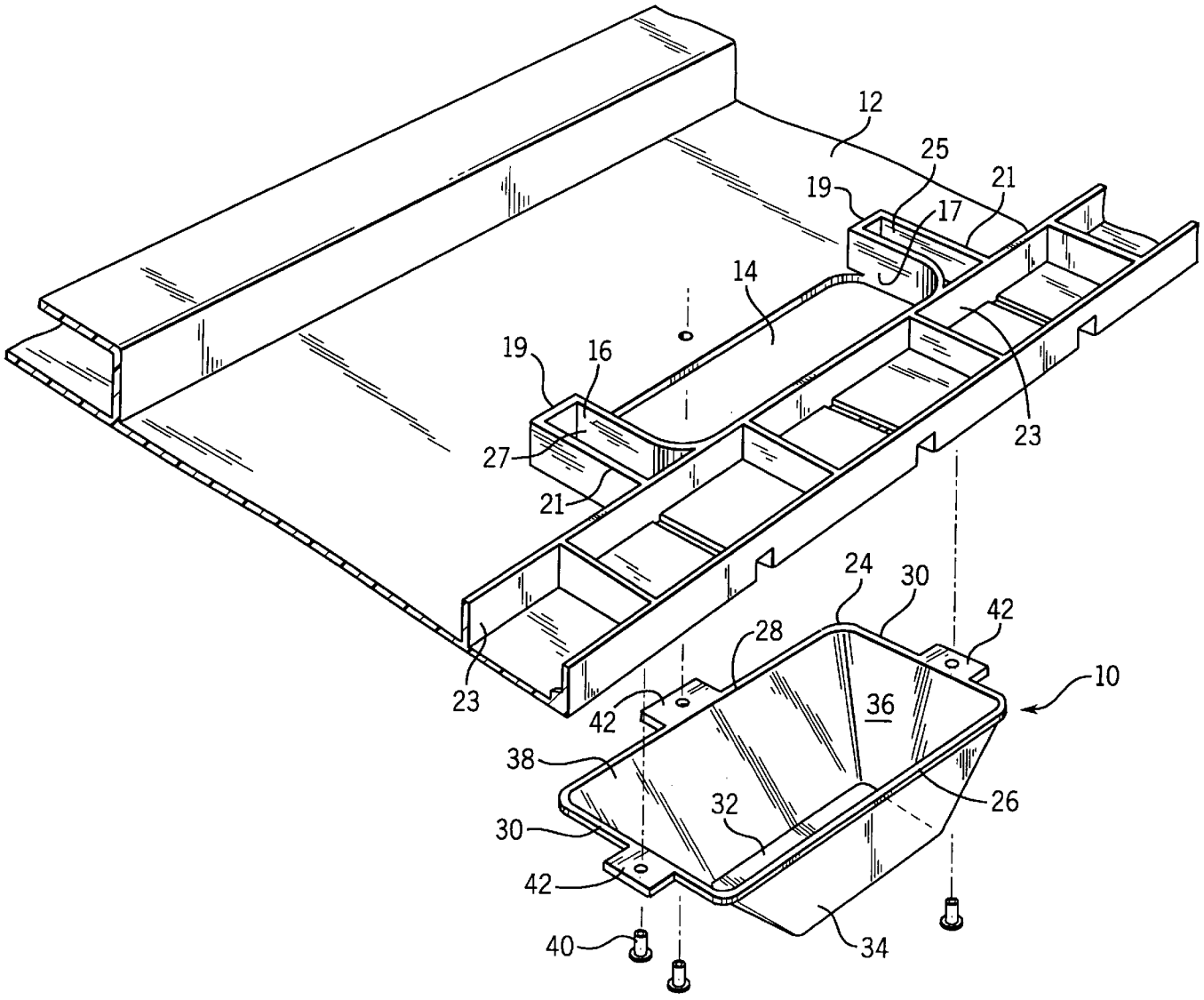
FIG. 2 is an exploded view similar to FIG. 1.

The cover 10 is shown in use on a typical molded plastic container having an end wall 12 which includes an elongated opening 14 defining a handle hole. A projecting rib 16 extends outwardly from the sides 17 and top 18 of the opening 14. The rib 16 is joined by ribs 20 to the top rim 22 of the container which also extends outwardly from the end wall 12. The opening 14 receives the fingers of a hand, and the projecting rib 16 and rim 22 provide a good ergonomic gripping area for the palm of the hand. Reinforcement ribs 19, 21 and 23 are also molded integrally with the wall 12 and rib 16 and, together with the rib 16, define pockets 25 and 27 adjacent to the respective sides 17 of the handle hole 14. The container is typically formed by injection molding polyethylene resin or the like.

The cover 10 is injection molded of preferably the same material as the container. The cover 10 forms a peripheral flange 24 having top and bottom runs 26 and 28, respectively, and side runs 30. The flange 24 defines a generally rectangular opening that is substantially coextensive in length (from side to side) with that of the handle hole 14 but greater in width (from top to bottom) than that of the handle hole 14. The cover 10 has a recessed portion extending rearwardly from the flange 24 and defined by a rear wall 32 connected to the flange 24 by a lateral top wall 34, inwardly sloping side walls 36, and an upwardly inclined bottom wall 38.

The cover 10 is adapted to be attached to the inside of the end wall 12 of the container with the bottom run 28 and side runs 30 of the flange 24 adjacent the bottom 31 and sides 17 of the handle hole 14. This places the top run 26 of the flange 24 substantially above the top 18 of the handle hole 14. A space is thereby provided for the distal phalanges of the fingers of a hand gripping the handle.

The cover 10 is preferably attached to the end wall 12 of the container by metal grommets 40 that extend through tabs 42 extending from the side runs 30 and bottom run 28 of the flanges 24. The grommets 40 are DOT® brand fasteners available from Scovill Fasteners Inc., Clarkesville, Ga., and have a larger, preformed inner flange 41 joined by a solid shank with tubular ends to a smaller outer flange 43, which is coined after the grommet is inserted through the tab 42 and wall 12. The grommets 40 are applied by forcing them through the tabs 42 and through the end wall 12. The grommets 40 through the side tabs 42 extend through the area of the wall 12 which is inside of the respective pockets 25 and 27, as best seen in FIG. 1. It is not necessary to drill holes in the tabs 42 or end wall 12. The result is a smooth, flush fastener that adds to the safe use of the cover 10 and container. Other fasteners could also be used to attach the cover 10 to the container.

The cover 10 can be added to existing containers, in the field or in the factory, as well as to newly constructed containers.

I claim:

1. In combination with a rigid plastic container having an end wall with an elongated handle hole, a cover fastened about the hole and comprising:

a rigid plastic peripheral flange against an inner side of said end wall, said flange surrounding the hole and having bottom, top, and side runs, the bottom and side runs being adjacent a bottom and sides of the hole, and the top run being spaced a distance above a top edge of the hole;

fasteners along the bottom and side runs of the flange extending through flange and the end wall securing the flange against the inner side of the end wall; and a rigid plastic enclosed recessed portion integrally formed with and extending from the flange into the interior of the container, said recessed portion being inside of said fasteners and including top side, bottom and rear walls which define a space inside the container which extends above the top edge of the hole and which is closed to the remainder of the interior of the container, said space providing a finger space inside the container above the top edge of the hole in which the distal phalanges of a user's fingers can be inserted.

2. The combination of claim 1, wherein the fasteners are grommets.

3. The combination of claim 2, wherein ribs integral with the end wall of the container define pockets adjacent to the sides of the handle hole, and the grommets extend into the pockets on an outer side of said end wall.

4. The combination of claim 1 wherein the rear wall of the recessed portion is connected to the top run of the flange by the top wall of the recessed portion, and the top wall of the recessed portion extends in a lateral plane into the interior of the container.

5. The combination of claim 4, wherein the side walls of the recessed portion slope inwardly so as to connect the rear wall to the side runs of the flange and an upwardly inclined bottom wall connects the rear wall to the bottom run of the flange, said upwardly inclined wall extending upwardly and connecting to said rear wall at approximately the level of said top edge of said handle hole.

* * * * *